US009805856B2

(12) United States Patent
Sasaki

(10) Patent No.: US 9,805,856 B2
(45) Date of Patent: Oct. 31, 2017

(54) COIL COMPONENT AND METHOD OF MANUFACTURING COIL COMPONENT

(71) Applicant: Sumida Corporation, Tokyo (JP)

(72) Inventor: Naoki Sasaki, Natori (JP)

(73) Assignee: SUMIDA CORPORATION (JP)

( * ) Notice: Subject to any disclaimer, the term of this patent is extended or adjusted under 35 U.S.C. 154(b) by 22 days.

(21) Appl. No.: 14/725,407

(22) Filed: May 29, 2015

(65) Prior Publication Data

US 2015/0357111 A1 Dec. 10, 2015

(30) Foreign Application Priority Data

Jun. 5, 2014 (JP) ..... 2014-116918

(51) Int. Cl.

| | |
|---|---|
| ***H01F 27/30*** | (2006.01) |
| ***H01F 27/29*** | (2006.01) |
| ***H01F 27/24*** | (2006.01) |
| ***H01F 27/02*** | (2006.01) |
| ***H01F 27/26*** | (2006.01) |
| ***H01F 5/04*** | (2006.01) |

(52) U.S. Cl.

CPC ..... *H01F 27/266* (2013.01); *H01F 5/04* (2013.01); *H01F 27/263* (2013.01); *H01F 27/29* (2013.01); *H01F 2005/043* (2013.01); *Y10T 29/49073* (2015.01)

(58) Field of Classification Search

CPC ..... H01F 27/266; H01F 27/29; H01F 27/263; H01F 41/0233

USPC ..... 336/198, 192, 83, 212, 208

See application file for complete search history.

(56) References Cited

U.S. PATENT DOCUMENTS

| | | | | |
|---|---|---|---|---|
| 4,549,158 | A | 10/1985 | Mitsui et al. | |
| 5,359,313 | A * | 10/1994 | Watanabe | H01F 3/14 336/178 |
| 7,646,276 | B2 * | 1/2010 | Yang | H01F 27/29 336/192 |
| 8,242,873 | B2 | 8/2012 | Hayasaki et al. | |
| 8,334,745 | B2 * | 12/2012 | Chen | H01F 27/326 336/170 |

(Continued)

FOREIGN PATENT DOCUMENTS

| | | |
|---|---|---|
| CN | 101719413 A | 6/2010 |
| JP | H05-28012 U | 4/1993 |

(Continued)

*Primary Examiner* — Tsz Chan
*Assistant Examiner* — Kazi Hossain
(74) *Attorney, Agent, or Firm* — Harness, Dickey & Pierce, P.L.C.

(57) ABSTRACT

A magnetic core (50) has a core shaft part which is inserted into a bobbin part, and configures a magnetic path of magnetic flux formed by a coil (40); the magnetic core (50) is configured by combining a pair of magnetic components (51, 52); the magnetic components (51, 52) have core ends formed so as to cross a core shaft part; the base part (20) has a fitting part which fits with at least one of the pair of core ends, when the core shaft part is inserted into the bobbin part; and the coil component (100) is characterized in that the pair of magnetic components (51, 52) and the bobbin base (10) are fixed to each other, while being bound by a sheet-like fixation member (70) which extends over the core end and the base part having been fitted to each other.

7 Claims, 7 Drawing Sheets

(56) References Cited

U.S. PATENT DOCUMENTS

| | | | | |
|---|---|---|---|---|
| 8,698,586 | B2 * | 4/2014 | Park | H01F 27/325 336/192 |
| 8,791,786 | B2 * | 7/2014 | Maeda | H01F 5/00 336/136 |
| 2004/0257190 | A1 * | 12/2004 | Peck | H01F 27/2847 336/212 |
| 2007/0126542 | A1 * | 6/2007 | He | H01F 27/027 336/83 |
| 2010/0156584 | A1 | 6/2010 | Yamaguchi et al. | |
| 2011/0050378 | A1 | 3/2011 | Kobayashi et al. | |
| 2012/0002387 | A1 * | 1/2012 | Park | H01F 27/325 361/760 |
| 2013/0141204 | A1 * | 6/2013 | Maeda | H01F 27/306 336/192 |
| 2014/0266559 | A1 * | 9/2014 | Yang | H01F 27/263 336/233 |
| 2015/0194257 | A1 * | 7/2015 | Chen | H01F 27/325 336/222 |
| 2016/0141094 | A1 * | 5/2016 | Liao | H01F 27/325 336/192 |

FOREIGN PATENT DOCUMENTS

| | | | |
|---|---|---|---|
| JP | H09-74025 | A | 3/1997 |
| JP | 2002-110433 | A | 4/2002 |
| JP | 2010-165857 | A | 7/2010 |

* cited by examiner

COIL COMPONENT AND METHOD OF MANUFACTURING COIL COMPONENT

This application is based on Japanese patent application No. 2014-116918, filed on Jun. 5, 2014, the content of which is incorporated hereinto by reference.

BACKGROUND

Technical Field

The present invention relates to a coil component having a bobbin base and a coil, and is typically used for a transformer, and a method of manufacturing such coil component.

Related Art

A variety of coil components, having a wire-wound coil, and a core (magnetic core) inserted therein, composed of a magnetic material, have been proposed.

Regarding this type of coil component, JP-U-H05-28012 describes a coil component in which a pair of cores (magnetic components), each having a groove formed on the outer circumference thereof, are abutted and bound by placing a tape so as to surround them while guided by the grooves. According to the description, the pair of magnetic components may be prevented from shifting from each other, and thereby a magnetic path having a desired shape may be formed in a stable manner.

JP-A-2010-165857 describes a coil component in which a first core and a second core, composed of a magnetic material and respectively having magnetic legs, are inserted into a bobbin having a coil wound therearound, so as to abut the magnetic legs, and the bonded portion is pressurized inwardly using an elastic member such as heat shrinkable tube. By using the bobbin, like the coil component described in JP-A-2010-165857, a bobbin and a coil having arbitrary shapes may be formed easily, and the core is prevented from being damaged by winding tension applied in the process of wire winding. According to JP-A-2010-165857, the heat shrinkable tube is wound around the outer side of the magnetic legs and the outer surface of the coil, in the direction normal to the winding axial direction of the bobbin. In this way, the pair of the first and second cores and the coil are joined by the heat shrinkable tube making use of frictional force.

In the coil components described in JP-U-H05-28012 and JP-A-2010-165857, a single magnetic core is configured by combining the pair of magnetic components which are inserted into the coil from both sides thereof in the winding axial direction.

A shift in the relative position of the coil and the magnetic core unfortunately causes fluctuation in inductance which is one of important characteristics of the coil component. In the coil component of JP-U-H05-28012, the pair of magnetic component, each having an "E-shape", are abutted and fixed by the tape, to configure the magnetic core. However, for the reasons regarding molding, a gap is inevitably produced between a center leg of the magnetic core and a center hole of an air-core coil, and this may cause a shift in the relative position between the magnetic and the air-core coil. Also in the coil component of JP-A-2010-165857, the magnetic core and the bobbin may cause positional shift in the process of assemblage, since the pair of magnetic components (first core, second core) and the coil are simply bound only with the aid of frictional force, while being pressurized by the heat shrinkable tube. As a consequence, the relative position between the magnetic core and the coil may vary, and the inductance may fluctuate. It has therefore been difficult for the coil components as disclosed in JP-U-H05-28012 and JP-A-2010-165857, to fix at least three components, including the pair of magnetic components and the core, without causing a shift in the relative position. This has caused variation in the inductance from product to product, and has degraded stability in product characteristics.

Meanwhile, one possible technique of fixing a desired relative position between the pair of magnetic components and the bobbin may be bonding of these members with an adhesive, while holding them using a special jig. This is however disadvantageous in terms of cost, since there are diversified shapes of the coil components, and this needs provision of special jigs for every product. Also the number of manufacturing processes will increase, due to needs for attaching these members to the jig, and then detaching them from the jig.

SUMMARY

The present invention was conceived to solve the problems described above, and an object thereof is to provide a coil component capable of ensuring stable product characteristics and good productivity, and a method of manufacturing such coil component.

According to the present invention, there is provided a coil component which includes:

a bobbin base having a hollow cylindrical bobbin part, and a base part provided adjoining to the bobbin part;

a coil wound around the bobbin part; and a magnetic core having a core shaft part which is inserted into the bobbin part, to configure a magnetic path of magnetic flux formed by the coil, the magnetic core being configured by combining a pair of magnetic components each having a core end which is formed so as to cross the core shaft part, the base part having a fitting part which fits with at least one of the core ends, when the core shaft part is inserted into the bobbin part, and the pair of magnetic components and the bobbin base are fixed to each other, while being bound by a sheet-like fixation member which extends over the core ends and the base part having been fitted to each other.

According to the present invention, there is also provided a method of manufacturing a coil component, the coil component includes a bobbin base having a hollow cylindrical bobbin part, and a base part provided adjoining to the bobbin part, and retaining terminal parts; a coil wound around the bobbin part; and a magnetic core being configured by combining a pair of magnetic components, and having a core shaft part which is inserted into the bobbin part, and a pair of core ends which are formed so as to cross the core shaft part, the method includes:

forming the coil by winding a wire around the bobbin part;

connecting leads of the wound wire drawn out from the coil to the terminal parts;

inserting the core shaft part into the bobbin part having the wire wound therearound, and fitting at least one of the pair of core ends to the base part, to configure a magnetic path of magnetic flux formed by the coil; and placing a sheet-like fixation member so as to extend over the at least one of the pair of core ends and the base part having been fitted to each other, to thereby bind the pair of magnetic components and the bobbin base together.

According to the present invention, since the magnetic components and the bobbin base are fixed, by placing the sheet-like fixation member so as to surround the core ends and the base part, so that the product characteristics such as inductance may be prevented from varying product from product. Since the fixation member is joined while at least one of the core ends of the magnetic core is fitted to the fitting part of the base part, so that positional shift between the magnetic components and the bobbin base may be suppressed easily without using any special jig.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION

Figure 1:
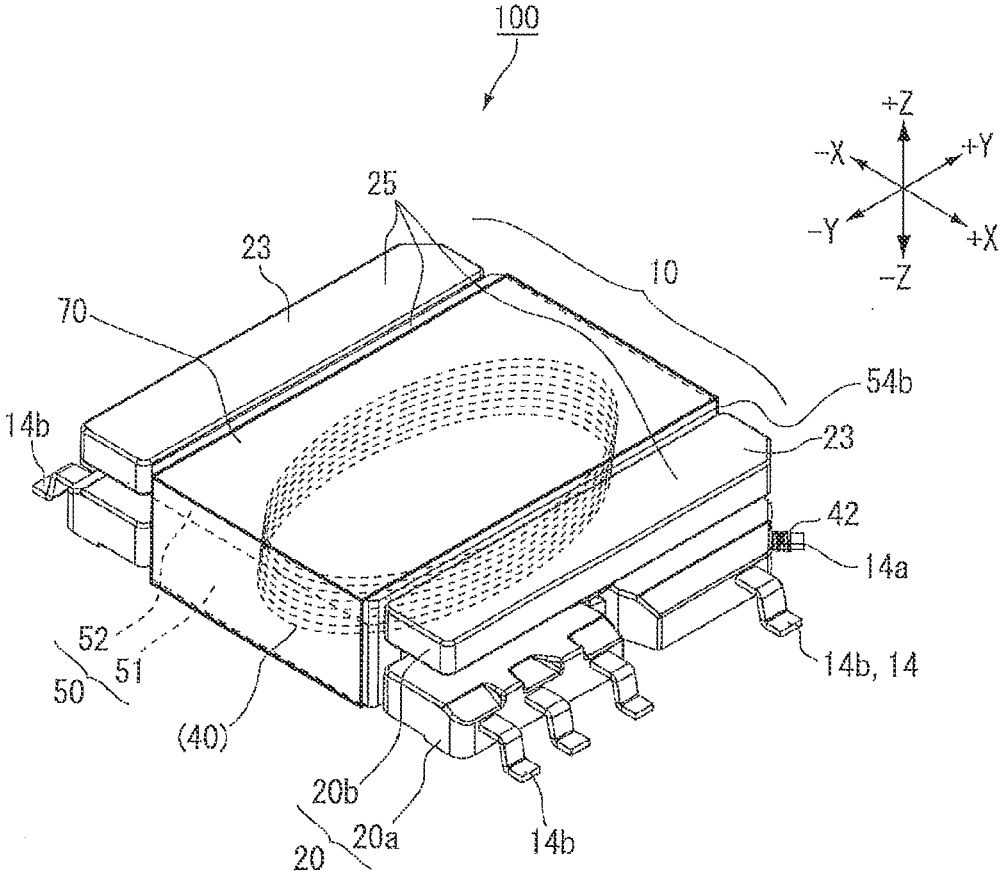
FIG. 1 is a top perspective view illustrating a coil component according to a first embodiment of the present invention.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Embodiment of the present invention will be explained below, referring to the attached drawings. In all drawings, all corresponding constituents will be given the common reference numerals so as to avoid repetitive explanation.

<First Embodiment>

Figure 2:
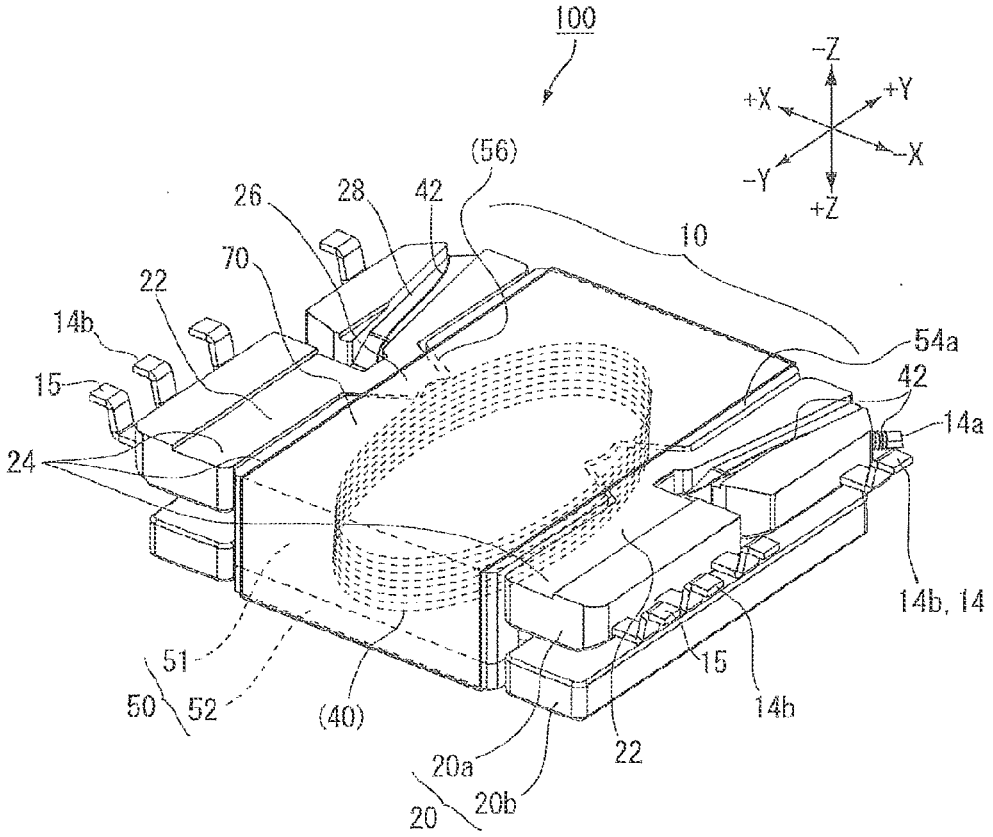
FIG. 2 is bottom perspective view illustrating the coil component of the first embodiment.
Figure 3:
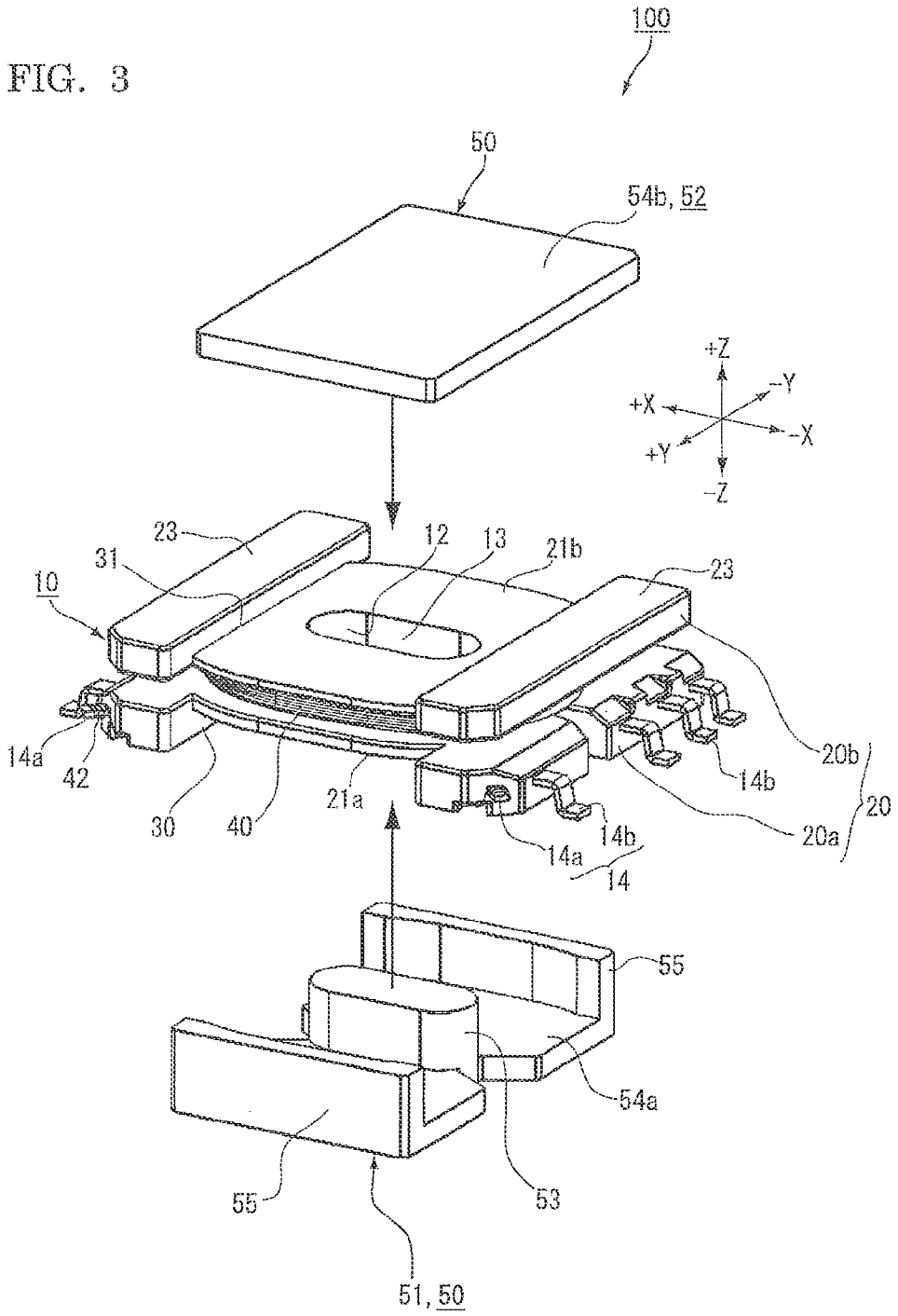
FIG. 3 is a top perspective view illustrating the pair of magnetic components and the bobbin base separated from each other.
Figure 4:
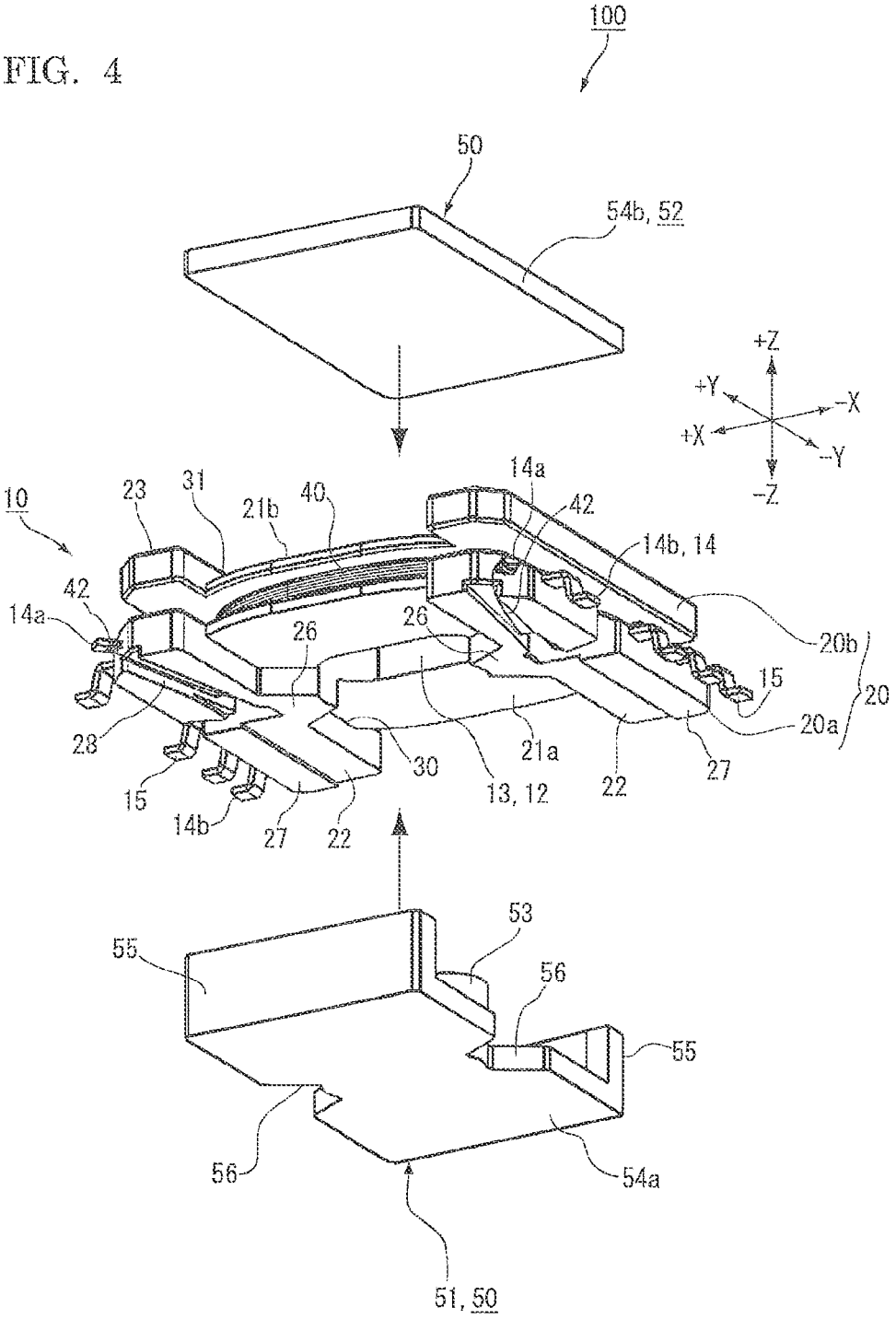
FIG. 4 is a bottom perspective view illustrating the pair of magnetic components and the bobbin base separated from each other.

FIG. 1 is a top perspective view illustrating a coil component 100 according to the first embodiment of the present invention. FIG. 2 is a bottom perspective view illustrating the coil component 100 of the first embodiment. FIG. 3 is a top perspective view illustrating a pair of magnetic components 51, 52 and a bobbin base 10 separated from each other. FIG. 4 is a bottom perspective view illustrating the pair of magnetic components 51, 52 and the bobbin base 10 separated from each other.

First, this embodiment will be outlined.

The coil component 100 of this embodiment has the bobbin base 10, a coil 40, and a magnetic core 50.

The bobbin base 10 has a hollow cylindrical bobbin part 12, and a base part 20 provided adjoining to the bobbin part 12. The coil 40 is wound around the bobbin part 12. The magnetic core 50 has a core shaft part 53 which is inserted into the bobbin part 12, to configure a magnetic path of magnetic flux formed by the coil 40. The magnetic core 50 is configured by combining the pair of magnetic components 51, 52. The magnetic components 51, 52 respectively have core ends 54*a*, 54*b* which are formed so as to cross the core shaft part 53. The base part 20 has fitting parts 30, 31 which fit with at least one of the pair of core ends 54*a*, 54*b*, when the core shaft part 53 is inserted into the bobbin part 12.

The coil component 100 of this embodiment is characterized in that the pair of magnetic components 51, 52 and the bobbin base 10 are fixed to each other, while being bound by a sheet-like fixation member 70 which extends over the core ends 54*a*, 54*b* and the base part 20 having been fitted to each other.

This embodiment will be detained next.

Now orthogonal three directions X, Y, Z are defined for convenience, as illustrated in FIG. 1 to FIG. 7. More specifically, the side on which soldered faces 15 of terminal parts 14 are provided is denoted as the −Z direction, and the opposite side is denoted as the +Z direction. A plane configured as an envelope of the plurality of soldered faces 15 of the terminal parts 14 is denoted as the XY-plane. In this embodiment, the direction in which the terminal parts 14 protrude out from the bobbin base 10 is denoted as the ±X direction, and the direction normal to both of the +Z direction and the +X direction is denoted as the +Y direction. In this specification, while the +Z direction and the −Z direction may occasionally be referred to as "upper" and "lower", respectively, the wording is merely for explaining the relative relation of the individual elements of the coil component 100 for convenience sake, so that the directions do not always agree with the perpendicularly upward and downward directions when the coil component 100 is manufactured or used. Similarly, while the face directed to the −Z side and the +Z side may occasionally be referred to as "lower face" and "upper face", respectively, these faces may be in an arbitrary relationship with the perpendicularly upward and downward directions, and do not always agree therewith.

For convenience sake, the plan view is referred to a visual observation from the +Z side, the front view is a visual observation from the +Y side, and the side view is a visual observation from the +X side. The ±Z directions may occasionally be referred to as the thicknesswise direction of the coil component 100, and the ±X directions may occasionally be referred to as the widthwise direction of the coil component 100.

The coil component 100 is a component having the coil 40, and is used as combined with other components (not illustrated) to configure various products. The coil component 100 is an inductor which produces inductance when electric current is fed to the coil 40. The number of coils 40 possessed by the coil component 100 may be one, or two or more. The coil component 100 is typically utilized as a transformer, choke coil and so forth.

The bobbin base 10 has the bobbin part 12 having the coil 40 wound therearound, and the base part 20 holding the terminal parts 14, and is a main body which configures the major structure of the coil component 100.

The bobbin part 12 refers to a winding shaft portion which has a hollow cylindrical shape, and has the coil 40 wound therearound. The bobbin part 12 has a throughhole 13 formed so as extend therethrough in the winding axial direction (Z direction). The base part 20 is a region of the bobbin base 10 other than the bobbin part 12 (winding shaft portion). More specifically, the base part 20 of this embodiment includes a lower base part 20*a* positioned below (on the −Z side of) the bobbin part 12, and an upper base part 20*b* positioned above (on the +Z side of) it.

The bobbin base 10 is configured by a single, or a plurality of components. While this embodiment exemplifies the bobbin base 10 configured by the bobbin part 12 and the base part 20 which are formed integrally and inseparably, the present invention is not limited thereto, so that a component containing the bobbin part 12 and a component containing the base part 20 may be independent and separable. The bobbin base 10 of this embodiment is configured by an insulating material as a whole, and more specifically configured by a thermosetting resin such as phenol resin, or a thermoplastic resin.

While the winding axial direction of the bobbin part 12 in this embodiment lies in the ±Z direction, the present invention is not limited thereto. The winding axial direction of the bobbin part 12 may lie in an in-plane direction in the XY plane, or a direction different from all of the X, Y and Z directions. One end of the winding axial direction of the bobbin part 12 is adjoined to the base part 20 (lower base part 20*a*), whereas the other end is attached with a flange part (upper base part 20*b*) having a larger diameter than the bobbin part 12. The lower base part 20*a* and the upper base part 20*b* configure the base part 20 together. Each of the lower base part 20*a* and the upper base part 20*b* have a near rectangular shape in a plan view. The lower base part 20*a* contains a planar flange part 21*a* which is formed integrally with the bottom end of the bobbin part 12, so as to restrict the coil 40 from loosening. Similarly, the upper base part 20*b* contains a planar flange part 21*b* formed integrally with the top end of the bobbin part 12, so as to restrict the coil 40 from loosening. The flange part 21*a* and the flange part 21*b* have nearly equal shape and size in a plan view. Of the flange parts 21*a*, 21*b*, the flange part 21*a* which falls on the side the terminal part 14 is formed, has a larger thickness than the other (flange part 21*b*) on the other side, so as to ensure a sufficient mechanical strength.

The coil 40 in this embodiment has a plurality of wound wires, and these wires share a single closed magnetic circuit. In this way, if one wire is fed with current to produce an electromagnetic field, the other will have current which flows therein by mutual induction. The coil component 100 may be used as a transformer, choke coil and so forth. The number of turns, thickness and material of the individual wires configuring the coil 40 may be selected depending on specifications of the coil component 100.

The magnetic core 50 is a member which configures a magnetic path of magnetic flux formed by the energized coil 40. The magnetic core 50 in this embodiment has a core shaft part 53 (center leg part) inserted into the bobbin part 12, and two peripheral magnetic legs 55 (outer leg parts) in which magnetic flux flows in the direction opposite to that in the core shaft part 53, by which a closed magnetic circuit structure is formed. Note that the magnetic core 50 may alternatively form an open magnetic circuit structure, as described later in a third embodiment. The magnetic core 50 in this embodiment is configured by combining the pair of magnetic components 51, 52. The magnetic component 51 in this embodiment has a sideways E-shape in a side elevation, meanwhile the magnetic component 52 has a sideways I-shape in a side elevation. In other words, the magnetic core 50 in this embodiment is a so-called E-I core, and the core shaft part 53 is provided only to the magnetic component 51. Note, however, that in place of this embodiment, the magnetic core 50 may be an E-E core in which each of the magnetic components 51, 52 has the E-shape with the core shaft part 53. Alternatively as explained later in the third embodiment, the magnetic core 50 may have an open magnetic circuit structure, in which the magnetic components 51, 52 have no peripheral magnetic legs 55. More specifically, both of the magnetic components 51, 52 may be T-cores which are configured by the core shaft part 53 and the core ends 54*a*, 54*b* arranged in the shape of letter T, and so that the magnetic core 50 is a so-called T-T core (see FIG. 7). Alternatively, the magnetic core 50 may be a so-called T-I core, in which one of the magnetic components 51, 52 is a T-core configured by the core shaft part 53 and the core end 54*a* (or core end 54*b*), and the other is an I-core such as the magnetic component 52 of this embodiment.

The magnetic component 51 is configured by the core shaft part 53, two peripheral magnetic legs 55, and the core end 54*a* which connects them. In contrast, the magnetic component 52 is solely configured by the core end 54*b* only, given the form of flat plate. The magnetic components 51, 52 are composed of the same magnetic material or different magnetic materials. The material is specifically exemplified by a ferromagnetic material such as ferrite.

As described above, the base part 20 includes the flange parts 21*a*, 21*b* formed on both ends in the winding axial direction of the bobbin part 12, and the fitting parts 30, 31 formed on the outer side of the flange parts 21*a*, 21*b*. The pair of magnetic components 51, 52 are respectively attached to both ends in the winding axial direction of the bobbin part 12, as indicated by the arrows in FIG. 3 and FIG. 4, so as to fit the core ends 54*a*, 54*b* respectively to the fitting parts 30, 31. The fitting parts 30, 31 in this embodiment are recesses formed in the base part 20 on both of upper and lower outer sides thereof.

As illustrated in FIG. 3, the upper base part 20*b* has formed therein the flange part 21*b* and an upper step part 23. A recess, which is attributable to a difference in level of height between the top surfaces of the upper step part 23 and the flange part 21*b*, corresponds to the fitting part 31.

As illustrated in FIG. 4, the lower base part 20*a* has formed therein the flange part 21*a*, a lower step part 22 and a side edge part 27. A recess, which is attributable to a difference in level of height between the bottom surfaces of the lower step part 22 and the flange part 21*a*, corresponds to the fitting part 30. The side edge part 27 is a thickened part which slightly protrudes downwards out from the lower step part 22. A plurality of terminal parts 14 are provided so as to respectively protrude sideward from the side edge part 27 (±X direction).

The base part 20 in this embodiment has a thicknesswise dimension (dimension in the Z direction) smaller than the widthwise dimension of (dimension in the X direction), and is therefore thin as a whole. To such base part 20, the core ends 54*a*, 54*b* of the magnetic core 50 are fitted so as not to increase the thicknesswise dimension.

While keeping the core shaft part 53 of the magnetic core 50 inserted into the bobbin part 12, the core end 54*a* of the magnetic component 51 is fitted to the fitting part 30, and the magnetic component 52 (core end 54*b*) is fitted to the fitting part 31. In this state, the top end of the core shaft part 53 may be abutted to the core end 54*b* and may be brought into close contact, or the core shaft part 53 and the core end 54*b* may be kept in proximity while placing a slight core gap (middle foot gap) in between. By forming the middle foot gap in this way, it now becomes possible to prevent abrasion between the core shaft part 53 and the core end 54*b*, and to thereby suppress howling of the core shaft part 53. The middle foot gap may be embedded in a resin adhesive. In this way, vibration of the core shaft part 53 may be reduced. Again by forming slight gaps (outer foot gaps) between the peripheral magnetic legs 55 and the magnetic component 52, howling of the peripheral magnetic legs 55 may be suppressed. By embedding the outer foot gaps with a resin adhesive, again vibration of the peripheral magnetic legs 55 may be reduced.

By fitting the core end 54*a* to the fitting part 30, the magnetic component 51 and the base part 20 may be restricted from relatively shifting in the XY-plane. Again by fitting the core end 54*b* to the fitting part 31, the magnetic component 52 and the base part 20 may be restricted from relatively shifting in the XY-plane.

The fixation member 70 is a member which binds the magnetic core 50 and the bobbin base 10 together. The fixation member 70 is a band-like adhesive tape, and is joined so as to surround the bobbin base 10, to thereby bind the pair of core ends 54*a*, 54*b* and the base part 20 together. Now "the fixation member 70 surrounds the bobbin base 10" means that the fixation member 70 is continuously placed over at least three arbitrary faces of the circumference of the bobbin base 10 around an arbitrary axis. In this embodiment, the fixation member 70 is provided along the +Z face (top face) and the −Z face (bottom face) of the bobbin base 10, and along at least one additional face. More specifically, the fixation member 70 is provided along the +Z face (top surface) and the −Z face (bottom face), and additionally along the +Y face and the −Y face. As a consequence, the pair of core ends 54*a*, 54*b* are mutually bound with the fixation member 70. The fixation member 70 is preferably provided around the bobbin base 10 over three or more faces thereof as described in this embodiment, and is more preferably provided so as to surround the bobbin base 10 over an angular range of 360° (or more) around an arbitrary axis. In this way, the bobbin base 10 and the magnetic core 50 may be bound more tightly.

The fixation member 70 has a base layer and an adhesive layer. The base layer is composed of a thin, flexible, band-like resin material. While the resin material is not specifically limited, a thermoplastic resin having a heat resistance of 250° C. or above, such as polyphenylene sulfide (PPS) resin or polyimide resin, may be used.

By joining the fixation member 70 over the core ends 54*a*, 54*b* and the base part 20, while keeping them mutually fitted, the magnetic core 50 and the base part 20 are fixed without causing the relative shift. Since the coil 40 wound around the bobbin part 12 of the base part 20 and the core shaft part 53 inserted into the bobbin part 12 may be suppressed from relatively shifting, so that the coil component 100 may be suppressed from varying in the inductance from product to product. At least three members, including the pair of magnetic components 51, 52 and the base part 20, may be fixed without causing the relative shift, simply by binding the magnetic core 50 and the base part 20 with the fixation member 70. Accordingly, the assemblage becomes easier and costs low, as compared with the bonding processes using an adhesive and special jig.

As illustrated in FIG. 1 and FIG. 2, the core ends 54*a*, 54*b* fitted to the fitting parts 30, 31 (see FIG. 3) configure a nearly flush surface with the base part 20. The fixation member 70 is joined to bonding faces 24, 25, so as to extend over the core ends 54*a*, 54*b* and the base part 20. Now "the core ends 54*a*, 54*b* configure a nearly flush surface with the base part 20" means that, when the magnetic core 50 is attached to the base part 20, difference in level of height between the outer faces of the core ends 54*a*, 54 and the base part 20 is smaller than the thickness of the core ends 54*a*, 54*b*. The bottom faces of the core end 54*a* and the lower step part 22 of the lower base part 20*a* configure a flush surface, or kept in close proximity with a slight difference in level of height, to thereby configure the bonding face 24 together. Meanwhile, the top faces of the core end 54*b* and the upper step part 23 of the upper base part 20*b* configure a flush surface, or kept in close proximity with a slight difference in level of height, to thereby configure the bonding face 25 together. According to this embodiment, the magnetic core 50 and the base part 20 may be bound in a simple and accurate manner, simply by joining the fixation member 70 in flat over the core end 54*a*, the core end 54*b* and the base part 20. More specifically, the bottom face of the core end 54*a* is positioned slightly lower than the bottom face of the lower step part 22 of the lower base part 20*a*. This allows tension of the fixation member 70, which extends over the lower step part 22 and the core end 54*a*, to push the core end 54*a* up to the +Z side. Meanwhile, the top face of the core end 54*b* is positioned slightly higher than the top face of the upper step part 23 of the upper base part 20*b*. This allows tension of the fixation member 70, which extends over the upper step part 23 and the core end 54*b*, to push the core end 54*b* down to the −Z side. Accordingly, the fixation member 70 which surrounds the base part 20 fastens the magnetic core 50 so as to press the magnetic components 51, 52 to each other. The magnetic components 51, 52 are thus fixed to the bobbin base 10 without loosening.

The bonding faces 24, 25 may be flat, or may slightly curve. For example, the top surfaces of the core end 54*b* and the upper step part 23 are understood to form a nearly flush surface, so long as the adjoining edges across which the fixation member 70 extends are kept at a nearly equal level of height. The level of height of the center portion of the core end 54*b*, away from the edge adjoining to the upper step part 23, may be arbitrary, and is therefore not always necessarily nearly equal to that of the upper step part 23. Accordingly, the center portion of the core end 54*b* may swell towards the +Z side or may recess towards the −Z side, so as to give a curved shape of the bonding face 25 as a whole. The same will apply to the bonding face 24.

The base part 20 (lower base part 20*a*) and the core end 54*a* respectively have a projection part 26 which configures a part of the bonding face 24, and a concave fitting recess 56 capable of housing the projection part 26. More specifically, as illustrated in FIG. 2 and FIG. 4, the projection part 26 is formed in the lower base part 20*a* of the base part 20, and the fitting recess 56 is formed in the core end 54*a* of the magnetic component 51. The fixation member 70 in this embodiment is joined so as to cover at least a part of each of the projection part 26 and the fitting recess 56 (see FIG. 2).

The projection part 26 is formed so as to protrude downward from the bottom face of the flange part 21*a*. The height of projection of the projection part 26 is equal to that of the lower step part 22, and the projection part 26 and the lower step part 22 are formed integrally without a boundary.

More specifically, the projection part 26 is provided to the base part 20 (lower base part 20*a*), so as to extend inwardly in the widthwise direction towards the core end 54*a* of the magnetic core 50. Meanwhile, on both sides in the widthwise direction of the core end 54*a*, there are formed the fitting recesses 56 which have a recessed shape corresponded to the projection parts 26. By fitting between the projection parts 26 and the fitting recesses 56, the magnetic component 51 and the lower base part 20*a* are suppressed from loosening.

As illustrated in FIG. 1 and FIG. 2, the widthwise dimension of the fixation member 70 in this embodiment is smaller than the widthwise dimension of the core ends 54*a*, 54*b*, and the fixation member 70 is joined within the width of the core ends 54*a*, 54*b*.

By forming the projection parts 26 so as to extend inwardly in the widthwise direction from the lower step part 22 as described in this embodiment, the lower base part 20*a* and the core end 54*a* may be joined even with the fixation member 70 having a smaller width than the core ends 54*a*, 54*b*. In other words, in the coil component 100 of this embodiment, the magnetic component 51 and the base part 20 are bound by joining the fixation member 70 which extends over the core end 54*a* to the projection part 26, within the width of the core end 54*a*. The fixation member 70 in this embodiment is wound around the bobbin base 10 and the magnetic core 50 assuming the X-axis as the winding axis, so that the magnetic component 51 and the magnetic component 52 are bound to each other by the fixation member 70. In this way, three members, including the pair of magnetic components 51, 52 and the bobbin base 10, are bound to each other with the fixation member 70, and the magnetic core 50 and the bobbin base 10 are suppressed from loosening, by virtue of the fitting between the projection part 26 and the fitting recess 56. The fixation member 70 has a narrower width than the magnetic core 50, so that a part of the core ends 54*a*, 54*b* of the magnetic core 50 exposes out from the fixation member 70. Accordingly, the magnetic core 50 in this embodiment may have any projections (not illustrated) or the like formed in this exposed area, and is given a larger degree of freedom of designing the magnetic core 50.

While this embodiment exemplified the case where the fitting recess 56 is formed in the core end 54*a*, and the projection part 26 is formed in the lower base part 20*a*, the present invention is not limited thereto. In place of this embodiment, the projection part 26 may be formed so as to protrude outward in the widthwise direction from the core end 54*a*, and the fitting recess 56 corresponded to the projection part 26 may be formed in the lower base part 20*a*.

The bobbin base 10 (base part 20) further has terminal parts 14, to each of which a lead of the wound wire 42 drawn out from the coil 40 is connected, are provided so as to protrude out from both sides of the bobbin base 10 while placing the fixation member 70 in between. The terminal parts 14 have soldered faces 15 positioned at a lower level of height than the fixation member 70. More specifically, the fixation member 70 which surrounds the magnetic core 50 will be positioned lower than the magnetic core 50, and the soldered face 15 of the terminal part 14 are positioned furthermore lower than the fixation member 70. Accordingly, the fixation member 70 will not physically interfere mounting of the coil component 100 onto a board (not illustrated).

The terminal parts 14 more specifically contain wound terminals 14*a* and mount terminals 14*b*. As illustrated in FIG. 2 and FIG. 4, the wound terminal 14*a* has wound and fixed thereon leads of the wound wires 42 respectively drawn out from a plurality of wound wires which compose the coil 40. The wound terminal 14*a* and the mount terminals 14*b* are electrically connected inside the lower base part 20*a*. There are the same number (4, for example) of wound terminals 14*a* and the leads of the wound wire 42 drawn out from the coil 40. A part of the plurality of mount terminals 14*b* may also be used as the wound terminal(s) 14*a*. In other words, any of the leads of the wound wire 42 of the coil 40 may be fixed by winding it around the mount terminal 14*b* in particular in the base portion thereof which protrudes laterally out from the lower base part 20*a* (not illustrated).

The bobbin base 10 has a guide groove 28 through which the leads of the wound wire 42 of the coil 40 are guided. More specifically, the guide groove 28 is formed on the bottom face side of the lower base part 20*a* which holds the terminal part 14, and the leads of the wound wire 42 drawn out from the coil 40 are guided through the guide groove 28 to the wound terminals 14*a*.

Each of the various constituents of the coil component 100 of the present invention is not always necessarily an independent something that exists, instead allowing that a plurality of constituents are configured to give a single member; that a single constituent is formed by a plurality of members; that a certain constituents is a part of other constituent; and that a part of a certain constituent overlaps with a part of other constituent.

This embodiment allows various modifications. For example, while this embodiment exemplified the case where the magnetic component 51 and the magnetic component 52 are not fitted, and instead the core shaft part 53 and the core end 54*b* are brought into contact by abutting them, or the core shaft part 53 and the core end 54*b* are kept in proximity in an non-contact manner, the present invention is not limited thereto. In place of this embodiment, the core shaft part 53 and the core end 54*b* may have irregularly-formed portions which can engage with each other, by which the relative shift between the magnetic component 51 and the magnetic component 52 in the XY-plane may be restricted. In this way, the magnetic core 50 as a whole may be aligned with the base part 20, simply by fitting either the magnetic component 51 or the magnetic component 52 to the base part 20.

While this embodiment exemplified the case where the fitting parts 30, 31 are formed as being recessed in the base part 20, so as to allow therein fitting of the core ends 54*a*, 54*b*, the present invention is not limited thereto. In place of this embodiment, notches or recesses (generally referred to as fitting recesses) may be formed in the core ends 54*a*, 54*b*, and projections may be formed as the fitting parts 30, 31 in the base part 20. Such fitting parts (projections) 30, 31 may be fitted to the recesses for fitting of the pair of core end 54*a*, 54*b*.

<Second Embodiment>

Figure 5:
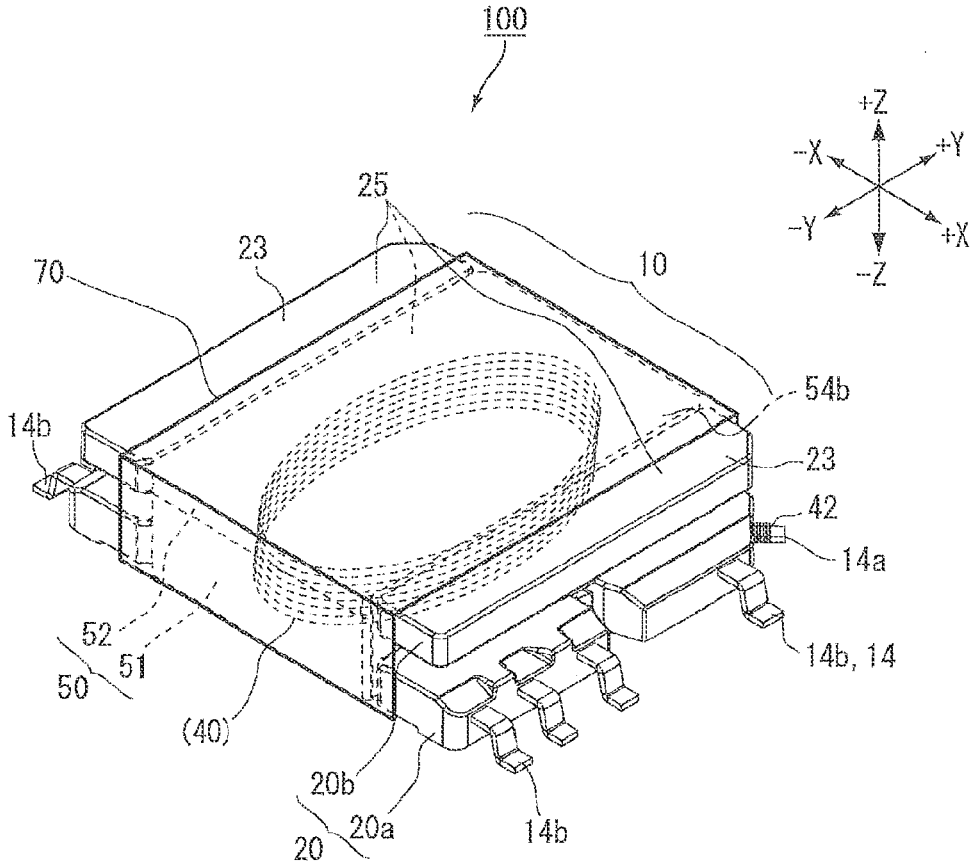
FIG. 5 is a top perspective view illustrating a coil component according to a second embodiment of the present invention.
Figure 6:
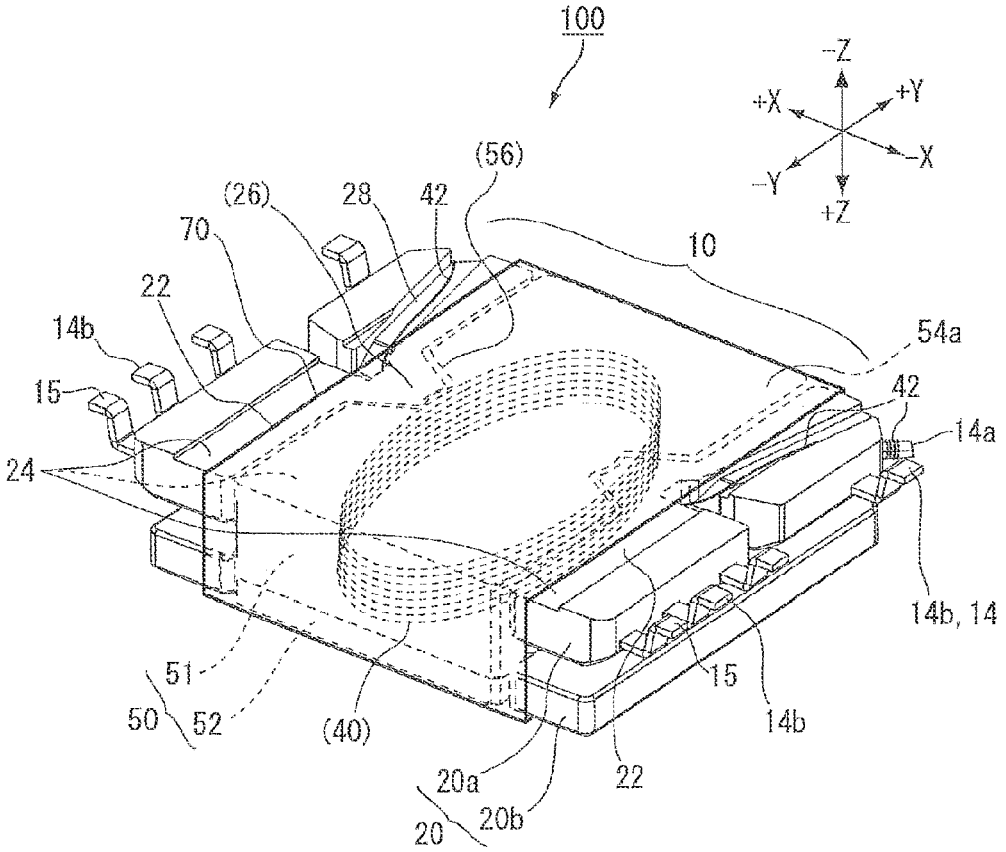
FIG. 6 is a bottom perspective view illustrating the coil component of the second embodiment.

FIG. 5 is a top perspective view illustrating the coil component 100 according to a second embodiment of the present invention. FIG. 6 is a bottom perspective view illustrating the coil component 100 according to the second embodiment.

The coil component 100 of this embodiment is different from the first embodiment, in that the widthwise dimension of the fixation member 70 is larger than the widthwise dimension of the core ends 54*a*, 54*b*, and therefore the fixation member 70 extends outwardly in the widthwise direction beyond both sides of the core ends 54*a*, 54*b*.

The coil component 100 of this embodiment will be detailed below, using common reference numerals with the first embodiment, so as to avoid repetitive explanation.

As illustrated in FIG. 5, the fixation member 70 in this embodiment extends outwardly in the widthwise direction beyond both sides of the core end 54*b* of the magnetic component 52, to thereby cover a part of the upper step part 23. In this way, the magnetic component 52 and the upper base part 20*b* are bound by the fixation member 70. Also as illustrated in FIG. 6, the fixation member 70 extends outwardly in the widthwise direction beyond both sides of the core end 54*a* of the magnetic component 51, to thereby cover a part of the lower step part 22. In this way, the magnetic component 51 and the lower base part 20*a* are bound by the fixation member 70. As a consequence, in the coil component 100 in this embodiment, not only the magnetic component 51 and the base part 20, but also the magnetic component 52 and the base part 20 are bound to each other by the fixation member 70, so as to prevent the positional shift. The fixation member 70 is further joined so as to surround the bobbin base 10, in the same way as in the first embodiment, and also the pair of core ends 54*a*, 54*b* are mutually bound with the fixation member 70.

According to this embodiment, since the fixation member 70 is joined to the lower base part 20*a* and the upper base part 20*b*, while being extended beyond the core ends 54*a*, 54*b*, so that the magnetic core 50 may be fixed to the bobbin base 10 with a larger adhesive force attributable to such wider area of joining.

The fixation member 70 of this embodiment covers at least a part of the guide groove 28 formed in the lower step part 22 of the lower base part 20*a*. The leads of the wound wire 42 are therefore restricted from dropping out from the guide groove 28 towards the bottom face side, and is prevented from sagging below the soldered face 15, even if the coil 40 should be loosened.

The coil component 100 of this embodiment is same as the first embodiment in that the projection part 26 is formed in the lower step part 22, and the fitting recess 56 is formed in the core end 54*a*. However, since the fixation member 70 of this embodiment has the widthwise dimension enough to cover the lower step part 22 while extending beyond the core end 54*a*, so that the core end 54*a* and the lower base part 20*a* may be fixed making use of a sufficiently large area of joining, without fitting the projection parts 26 into the core end 54*a* elsewhere within the width thereof. The projection part 26 and the fitting recess 56 are therefore omissible in this embodiment. However, by providing the projection part 26 and the fitting recess 56 as described in this embodiment, the lower base part 20*a* and the core end 54*a* are prevented from loosening, and the base part 20 and the magnetic component 51 may be improved in accuracy of alignment when the fixation member 70 is joined.

<Method of Manufacturing Coil Component 100>

The method of manufacturing the coil components 100 of the first and second embodiment (referred to as "this method", hereinafter) will be explained. In the explanation below, while this method may occasionally be explained referring to a plurality of steps which are illustrated in order, such order of description by no means limits the order or time according to which a plurality of steps are executed. When implementing this method, the order of plurality of steps may be modified without adversely affecting results of the individual steps, and the plurality of steps may partially or totally overlap on a time scale.

First, this method will be outlined.

This method is a method of manufacturing the coil component 100 of this embodiment, which includes the bobbin base 10 having the hollow cylindrical bobbin part 12 and the base part 20; the coil 40; and the magnetic core 50. In the coil component 100 manufactured by this method, the base part 20 is provided adjoining to the bobbin part 12 and retains the terminal parts 14; and the coil 40 is wound around the bobbin part 12. The magnetic core 50 is configured by combining the pair of magnetic components 51, 52, and has the core shaft part 53 which is inserted into the bobbin part 12, and the pair of core ends 54*a*, 54*b* which are formed so as to cross the core shaft part 53.

This method includes at least a coil forming step, a lead connecting step, a core fitting step, and a joining step.

In the coil forming step, the coil 40 is formed by winding wires around the bobbin part 12.

In the lead connecting step, leads of the wound wire 42 drawn out from the coil 40 are connected to the terminal parts 14 (wound terminal 14*a*).

In the core fitting step, the core shaft part 53 is inserted into the bobbin part 12 having the wires wound therearound, and at least one of the pair of core ends 54*a*, 54*b* is fitted to the base part 20, to thereby configure a magnetic path of magnetic flux formed by the coil 40.

In the joining step, the sheet-like fixation member 70 is placed so as to extend over the core ends 54*a*, 54*b* and the base part 20 having been fitted to each other, to thereby bind the pair of magnetic components 51, 52 and the bobbin base 10 together.

Next, this method will be detailed.

In advance of the coil forming step, the bobbin base 10 having the terminal parts 14 is formed by injection (insert) molding using a resin material. The terminal parts 14 are preliminarily inserted in a molding die, around which the resin material is injected.

The coil forming step then follows. In the coil forming step, the coil 40 is formed by winding wires around the bobbin part 12, while inserting a core bar (also referred to as mandrel, not illustrated) of a coil winding machine into the throughhole 13 of the bobbin part 12. The coil 40 is configured by a plurality of wires. The coil 40 may be formed by multiple winding of the plurality of wires in a stacked manner, or independent winding in different areas of the bobbin part 12 aligned in the winding axial direction.

The lead connecting step and the core fitting step may follow an arbitrary order. The lead connecting step may succeed the joining step described later.

In the lead connecting step, the leads of the round wire 42, which are the ends of the wires drawn out from the coil 40 formed by winding in the coil forming step, are fixed by winding them around the wound terminals 14*a* of the terminal parts 14. It is optionally possible to fuse the wound terminals 14*a*, or to coat a solder or electro-conductive adhesive, so as to fix the leads of the wound wires 42 to the wound terminals 14*a*. In the core fitting step, the core shaft part 53 of the magnetic core 50 is inserted into the through-hole 13 from which the core bar has been removed after winding up the coil 40. In this method, the core end 54*a* and the core end 54*b* are then fitted respectively to the fitting parts 30, 31 of the base part 20. In this process, the lower base part 20*a* and the core ends 54*a* are aligned by fitting the projection parts 26 of the former to the fitting recesses 56 of the latter.

In the joining step, the fixation member 70 is placed so as to extend over the preliminarily aligned lower base part 20*a* and the core end 54*a*. The sheet-like band 70 is further allowed to go around an arbitrary axis (around the X axis in this method). In this way, the magnetic component 51 and the magnetic component 52 are bound by the fixation member 70 while being aligned. As a consequence, the magnetic component 52 and the upper base part 20*b* may be restricted from relatively shifting. For the case where the fixation member 70 which is made wider than the magnetic core 50 is used, as in the coil component 100 of the second embodiment, the core end 54*b* of the magnetic component 52 and the upper base part 20*b* are mutually bound with the fixation member 70 in the joining step.

In the joining step, after the fixation member 70 was joined, an adhesive may be coated supplementarily between the magnetic core 50 and the bobbin base 10. This more tightly binds the magnetic core 50 and the bobbin base 10. Note that, since the magnetic core 50 and the bobbin base 10 have already been aligned by the fixation member 70, so that the supplemental coating of adhesive needs no special jig.

The coil components 100 of the first and second embodiments are thus manufactured.

<Third Embodiment>

Figure 7:
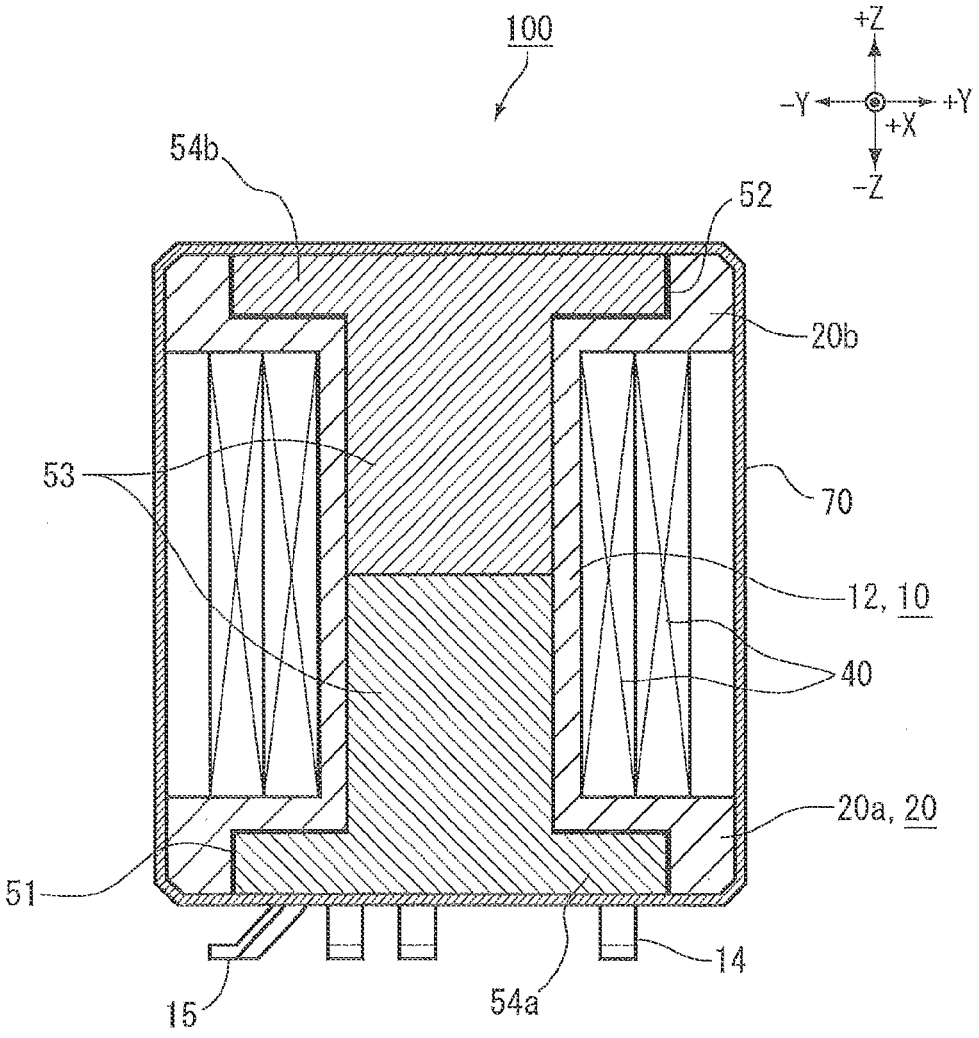
FIG. 7 is a schematic vertical cross sectional view illustrating a coil component of a third embodiment of the present invention, taken along the winding axial direction.

FIG. 7 is a schematic vertical cross sectional view illustrating a coil component of a third embodiment of the present invention, taken along the winging axial direction.

The magnetic core 50 in this embodiment is different from those of the first and second embodiments, in that it forms an open magnetic circuit structure. More specifically, the magnetic core 50 in this embodiment is different from those of the first and second embodiments, in that it has no peripheral magnetic leg 55 (see FIG. 3), and instead both of the magnetic components 51, 52 respectively have the core shaft parts 53. The magnetic components 51, 52 in this embodiment have a nearly T-shape, and have the same shape. The core shaft part 53 has the core end 54*a* at the bottom end thereof, and has the core end 54*b* at the top end thereof. The core shaft part 53 (middle foot portions) of the magnetic components 51, 52 are inserted into the bobbin part 12 from both sides in the winding axial direction, and abutted. Around the bobbin part 12, the coil 40 is provided by multiple winding of a plurality of wires in a stacked manner. The core end 54*a* of the magnetic component 51 is fitted to the lower base part 20*a*, and the core end 54*b* of the magnetic component 52 is fitted to the upper base part 20*b*.

This embodiment is same as the first and second embodiments in that the sheet-like fixation member 70 is placed so as to extend over the core ends 54*a*, 54*b* and the base part 20 having been fitted, to thereby bind the pair of magnetic components 51, 52 and the bobbin base 10 together.

The fixation member 70 is joined so as to surround the bobbin base 10 to thereby bind the pair of core ends 54*a*, 54*b* and the base part 20 together. The fixation member 70 is in common with the first embodiment, in that it is provided so as to extend along not only the +Z face (top face) and the −Z face (bottom face) of the bobbin base 10, but also along at least one additional face.

Also regarding the magnetic core 50 having the open magnetic circuit structure as in this embodiment, by binding it together with the bobbin base 10 using the fixation member 70 to thereby suppress the positional shift between the core shaft part 53 and the coil 40, the inductance may be suppressed from varying product from product.

According to the present invention, there is provided a coil component capable of ensuring stable product characteristics and good productivity, and a method of manufacturing the same.

It is apparent that the present invention is not limited to the above embodiment, and may be modified and changed without departing from the scope and spirit of the invention.

These embodiments also embrace the technical spirits below:

(1) A coil component which includes:

a bobbin base having a hollow cylindrical bobbin part, and a base part provided adjoining to the bobbin part;

a coil wound around the bobbin part; and a magnetic core having a core shaft part which is inserted into the bobbin part, to configure a magnetic path of magnetic flux formed by the coil, the magnetic core being configured by combining a pair of magnetic components each having a core end which is formed so as to cross the core shaft part, the base part having a fitting part which fits with at least one of the core ends, when the core shaft part is inserted into the bobbin part, and the pair of magnetic components and the bobbin base are fixed to each other, while being bound by a sheet-like fixation member which extends over the core ends and the base part having been fitted to each other.

(2) The coil component according to (1), wherein the at least one of the core ends fitted to the fitting part and the base part configure a nearly flush surface, and the fixation member is joined to the bonding surface so as to extend over the at least one of the core ends and the base part.

(3) The coil component according to (2), wherein the base part and the at least one of the core ends respectively have a projection part which configures a part of the bonding face and a concave fitting recess capable of housing the projection part, and the fixation member is joined so as to cover at least a part of each of the projection part and the fitting recess.

(4) The coil component according to (3), wherein the projection part is provided to the base part, so as to extend inwardly in the widthwise direction towards the core end, and the widthwise dimension of the fixation member is smaller than the widthwise dimension of the at least one of the core ends, and the fixation member is joined within the width of the at least one of the core ends.

(5) The coil component according to any one of (1) to (3), wherein the widthwise dimension of the fixation member is larger than the widthwise dimension of the core ends, and the fixation member extends outwardly in the widthwise direction beyond both sides of the at least one of the core ends.

(6) The coil component according to any one of (1) to (5), wherein the base part comprises flange parts formed on both ends in a winding axial direction of the bobbin part, and fitting parts formed on the outer side of the flange parts, the pair of magnetic components are respectively attached to both end, in the winding axial direction of the bobbin part, so as to fit the core ends respectively to the fitting parts, and the fixation member is a band-like adhesive tape, and is placed so as to surround the bobbin base, to thereby bind the core ends and the base part together.

(7) The coil component according to (6), further comprising terminal parts, to each of which a lead of the wound wire drawn out from the coil is connected, are provided so as to protrude out from both sides of the bobbin base while placing the fixation member in between, and the terminal parts have soldered faces positioned at a lower level than the fixation member.

(8) The coil component according to (7), wherein the bobbin base has a guide groove through which the leads of the wound wire are guided, and the fixation member covers at least a part of the guide groove.

(9) A method of manufacturing a coil component, the coil component includes a bobbin base having a hollow cylindrical bobbin part, and a base part provided adjoining to the bobbin part, and retaining terminal parts; a coil wound around the bobbin part; and a magnetic core being configured by combining a pair of magnetic components, and having a core shaft part which is inserted into the bobbin part, and a pair of core ends which are formed so as to cross the core shaft part, the method includes:

forming the coil by winding a wire around the bobbin part;

connecting leads of the wound wire drawn out from the coil to the terminal parts;

inserting the core shaft part into the bobbin part having the wire wound therearound, and fitting at least one of the pair of core ends to the base part, to configure a magnetic path of magnetic flux formed by the coil; and placing a sheet-like fixation member so as to extend over the at least one of the pair of core ends and the base part having been fitted to each other, to thereby bind the pair of magnetic components and the bobbin base together.

What is claimed is:

1. A coil component comprising:

a bobbin member having a hollow cylindrical bobbin and a bobbin base adjoining the hollow cylindrical bobbin;

a coil wound around the hollow cylindrical bobbin;

a magnetic core having a core shaft and a pair of magnetic components, the pair of magnetic components sandwiching the core shaft, the core shaft being inserted into the hollow cylindrical bobbin so as to configure a magnetic path of magnetic flux formed by the coil; and a sheet-shaped fixation member that fixes the bobbin member to the magnetic core, wherein an extending direction of each pair of magnetic components is perpendicular to an axial direction of the core shaft, the bobbin base has a first fitting part which fits with at least one of the pair of magnetic components when the core shaft is inserted into the hollow cylindrical bobbin, an upper surface of a least one of the pair of magnetic components is substantially co-planar with an upper surface of the first fitting part at an interface thereof, and the sheet-shaped fixation member extends over the interface, and the bobbin base has one of a projection and a concave fitting recess, at least one of the pair of magnetic components has the other of the projection and the concave fitting recess, the projection and the concave fitting recess are fit to each other, and the sheet-shaped fixation member fixes the projection to the concave fitting recess.

2. The coil component according to claim 1, wherein the projection is provided to the bobbin base, and the projection projects parallel to the extending direction toward the core shaft, and a width of the sheet-shaped fixation member is smaller than a width of at least one of the pair of magnetic components so that the sheet-shaped fixation member is laterally offset from edges of the at least one of the pair of magnetic components.

3. The coil component according to claim 1, wherein a width of the sheet-shaped fixation member is larger than a width of at least one of the pair of magnetic components so that the sheet-shaped fixation member completely covers the at least one of the pair of magnetic components in a plan view.

4. The coil component according to claim 1, wherein the bobbin base has first and second flanges at both ends thereof in the axial direction, and a combined fitting part is configured with the first fitting part and a second fitting part formed on peripheral sides of the first and second flanges, respectively, the pair of magnetic components sandwich the first and second flanges in the axial direction so as to fit edges of the pair of magnetic components to the first and second fitting parts, respectively, and the sheet-shaped fixation member is a band-like adhesive tape, the band-like adhesive tape surrounds the bobbin member so as to adhesively secure the first and second fitting parts and the pair of magnetic components together, and a surrounding axis of the band-like adhesive tape is perpendicular to the axial direction of the core shaft.

5. The coil component according to claim 4, further comprising:

first and second terminals that are provided at outer edges of the first and second fitting parts, respectively, so as to outwardly protrude from both sides of the bobbin member while having the fixation member placed there between, wherein winding wire leads of the coil are connected to the first and second terminals, and tips of the first and second terminals are located outside of an area configured by the bobbin member, the magnetic core, and the sheet-shaped fixation member.

6. The coil component according to claim 5, wherein the bobbin member has a guide groove through which the winding wire leads of the coil are guided, and the sheet-shaped fixation member covers at least a part of the guide groove.

7. A coil component comprising:

a bobbin member having a hollow cylindrical bobbin and a bobbin base adjoining the hollow cylindrical bobbin;

a coil wound around the hollow cylindrical bobbin;

a magnetic core having a core shaft and a pair of magnetic components, the pair of magnetic components sandwiching the core shaft, the core shaft being inserted into the hollow cylindrical bobbin so as to configure a magnetic path of magnetic flux formed by the coil; and a sheet-shaped fixation member that fixes the bobbin member to the magnetic core, wherein an extending direction of each of the pair of magnetic components is perpendicular to an axial direction of the core shaft, the bobbin base has a fitting part which fits with at least one of the pair of magnetic components when the core shaft is inserted into the hollow cylindrical bobbin, wherein the bobbin member has a guide groove through which winding wire leads of the coil are guided, and the sheet-shaped fixation member covers at least a part of the guide groove.

* * * * *